US005135369A

United States Patent [19]

White, Jr.

[11] Patent Number: 5,135,369

[45] Date of Patent: Aug. 4, 1992

[54] DEVICE WITH ORBITING VALVE HAVING A SEAL PISTON

[75] Inventor: Hollis N. White, Jr., Hopkinsville, Ky.

[73] Assignee: White Hydraulics, Inc., Hopkinsville, Ky.

[21] Appl. No.: 580,072

[22] Filed: Sep. 10, 1990

[51] Int. Cl.[5] ..... F01C 1/10; F01C 19/08; F16K 25/00

[52] U.S. Cl. ..... 418/61.3; 137/625.2; 251/176

[58] Field of Search ..... 418/61.3; 251/175, 176; 137/625.2

[56] References Cited

U.S. PATENT DOCUMENTS

| | | | |
|---|---|---|---|
| 2,984,223 | 5/1961 | Budzich | 251/175 |
| 3,289,601 | 12/1966 | Compton | 418/61.3 |
| 3,572,983 | 3/1971 | McDermott | 418/61.3 |
| 4,298,318 | 11/1981 | Tsuchiya et al. | 418/61.3 |
| 4,480,971 | 11/1984 | Swedberg | 418/61.3 |
| 4,976,594 | 12/1990 | Bernstrom | 418/61.3 |

*Primary Examiner*—John J. Vrablik

*Attorney, Agent, or Firm*—Woodling, Krost & Rust

[57] ABSTRACT

A closed center gerotor device wherein the sealing between the commutator for the device and the surrounding body is provided by a wave spring biased "O" ring sealed pressure operated piston.

19 Claims, 4 Drawing Sheets

DEVICE WITH ORBITING VALVE HAVING A SEAL PISTON

FIELD OF THE INVENTION

This invention relates to a hydraulic gerotor motor.

BACKGROUND OF THE INVENTION

Closed center gerotor motors have many advantages, a number of which are described in Hollis White's seminal U.S. Pat. No. 4,877,383 (Device Having A Sealed Control Opening And An Orbiting Valve). This present invention is directed to an improvement to the closed center type devices wherein the seal for the central drive opening of the commutator valve is provided through the use of a moveable piston. This seals the opening while also providing additional advantages.

SUMMARY OF THE INVENTION

The present invention is directed to providing an improved seal for a closed center device.

It is an object of this invention to increase the strength of wobblestick drive interconnection with commutator valves.

It is an object of this invention to reduce the complexity of seals for closed center gerotor devices.

It is an object of this invention to relocate the seal for a closed center gerotor device.

It is an object of this invention to simplify gerotor devices.

It is an object of this invention to increase the efficiency of hydraulic motor devices.

Other objects and a more complete understanding of the invention may be had by referring to the following specification and drawings in which:

DESCRIPTION OF THE PREFERRED EMBODIMENT

This invention relates to an improved closed center gerotor device. A basic description of a closed center device is to be found in Hollis White's U.S. Pat. No. 4,877,383 (Device Having A Sealed Control Opening And An Orbiting Valve). The preferred embodiment of U.S. Pat. No. 4,877,383 uses separate "O" ring seals for a valve 14 in addition to a pin interconnection between the wobblestick 15 and valve 14. This design is serviceable. It is also reasonably complex with the specific diameters and locations of various parts restricted by the presence of the "O" ring seals.

Figure 1:
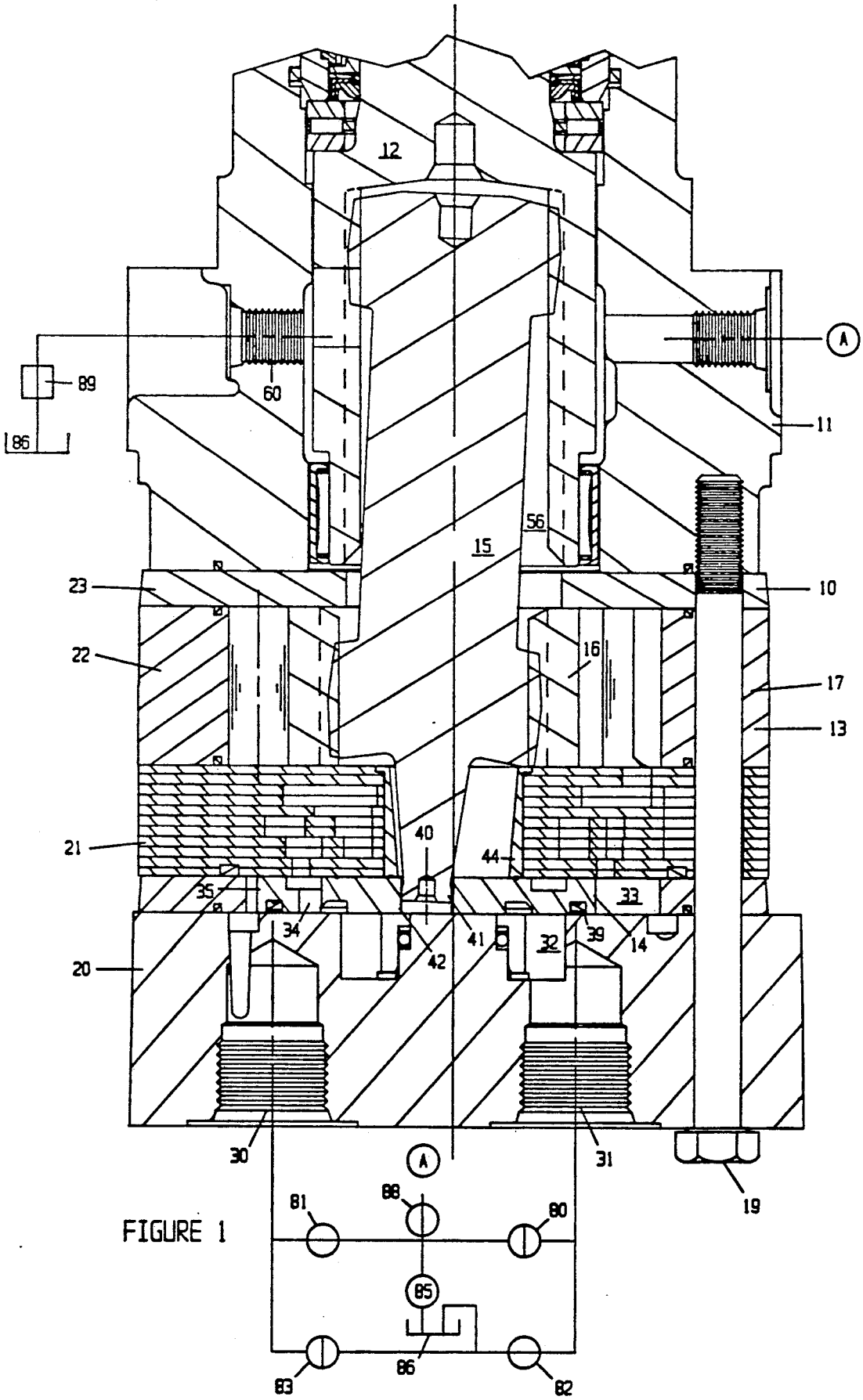
FIG. 1 is a central longitudinal cross sectional view of a gerotor structure incorporating the invention.

This invention relates to an improved gerotor device using a piston to provide for the closed center seal. This piston improves the sealing between the moving valve and the stationary device. The piston also allows for usage of an integral toe wobblestick. The invention will be described in the preferred environment of a gerotor motor/pump 10 a having a housing 11 containing a drive shaft 12 connected to a gerotor structure 13 and rotary valve 14 via a wobblestick 15 (FIG. 1). The gerotor device 10 can produce power when fluidically connected as a motor to a source of high pressure or it can produce high pressure fluid when physically connected as a pump to a source of unpressurized fluid. The device is described as a motor.

The drive shaft 12 is located in the housing 11 for rotation in respect thereto. In a gerotor motor, such as that disclosed in Mr. White's prior U.S. Pat No. 3,606,601, the speed and direction of rotation of this shaft 12 is governed by the volume, pressure and direction of flow of the fluid through the gerotor structure 13. In the embodiment shown in the present application the fluid flow through the device is controlled by four valves 80, 81, 82 and 83. These valves 80–83 are selectively operated to connect a port 30, 31 to a fluid pump 85 (source of pressurized fluid) and to connect the other port 30, 31 to the sump 86 (discharge of fluid) from which the pump 85 draws fluid. In the embodiment shown an auxiliary port A can be also selectively connected via valve 88 to the fluid pump 85 to lubricate and cool the bearings of the device if needed. A filter 89 filters this lubrication loop fluid before discharge to the sump 86, thus effectively isolating the lubrication function from the power function of the device. The center of the device is isolated by the closed center seal. For this reason a totally separate fluid loop can be utilized to circulate fluid through the center of the device, a mere drain, can be utilized to drain off any incidental fluid that enters the center of the device, no fluid connections could be utilized allowing fluid to self circulate in the center of the device, as disclosed by U.S. Pat. No. 4,940,401 a single ended chattering ball pump could be used off of an occasionally pressurized area to circulate fluid from the center of the device to the occasionally pressurized area, or other fluid handling means could be utilized with such isolated center.

The shape of the housing 11 of this current motor/pump 10 is designed to match the intended application, even to the extent of being integral thereto (a feature allowed by the isolation of fluid within the gerotor structure 13 as will be later described).

The gerotor structure 13 is removably attached to the housing 11, preferably by bolts 19. The gerotor structure 13 include an end plate 20, a manifold plate 21, a gerotor device 22 and a balancing plate 23 fixedly attached together by bolts (not shown) so as to produce a single integral unit. The gerotor device shown is an orbiting rotor 16 within a stationary stator 17. Other pressure mechanisms could also be used as the power generating means for the device.

The end plate 20 is the termination cap and porting plate for the device 10. The plate 20 can be of single (FIGS. 1–3) or multiplate (FIG. 4) design. Two ports 30, 31 are formed into the plate 20 so as to form the fluid connections for the device. One port 31 connects to a commutation ring or passage 32 in the opposing face of the plate 20. This commutation ring or passage 32 in turn communicates with the central section 34 of the orbiting valve 14 to provide a fluid connection therefor. The other port 30 connects to a ring-shaped cavity 33 on the opposing side of the plate 20. This cavity 33 surrounds the outside circumferential edge 35 of the orbiting valve 14 to provide a second fluid connection to the valve 14.

The orbiting valve 14 is the main valve for the device 10. The particular embodiment of FIGS. 1–3 utilizes a conventional ring shaped valve having a circular center opening 34 and a surrounding circular edge 35. The center opening 34 of the valve 14 communicates with one port 31 via the ring or passage 32. The external side about outer edge 35 of the valve 14 communicates with the other port 30. (Due to the fact that there is a space between the outermost surface of the orbiting valve 14, fluid is able to freely move about the outside of the valve 14). The embodiment of FIG. 4 uses an orbiting movement of a modified valve 14 as the main valve for the device. In contrast with FIGS. 1-3, the orbiting valve 14 is connected to the wobblestick 15 for rotation therewith and there are discreet openings for the center opening 34 and indented scallops in the outer edge 35. This allows the overall device to be smaller than in a circular valve device. A more detailed discussion of this valve 14 is found in Mr. White's presently pending application Ser. No. 07/471,475 filed Jan. 29, 1990 for a Reduced Sized Hydraulic Motor. In both embodiments the valve 14 is an orbiting valve that selectively interconnects fluid of two ports to expanding and contracting gerotor cells through bi-directional fluid passages in the stationary body of the housing of the device. This is preferred.

The manifold plate 21 is on the opposing side of the orbiting valve 14 from the end plate 20 between the valve 14 and rotor 16. The manifold plate 21 serves to connect the center 34 and outer 35 sections of the orbiting valve 14 to the gerotor cells between the rotor 16 and stator 17 selectively as the device is operated. The manifold plate 21 itself is formed as a brazed assembly of thin stamped plates as taught in Mr. White's U.S. Pat. No. 4,697,997.

Pressurized fluid is not introduced into the central wobblestick drive opening of the manifold 21 unless desired (for example, a separate bearing lubrication loop). The pressurized fluid is instead segregated to the area of the device near the orbiting valve 14 by the sealing of the wobblestick drive connection to the valve 14. This sealing is accomplished by restricting the effective size of the drive opening through the manifold plate 21 to an area capable of being sealed by the inside drive surface of the valve 14. To accomplish this the radius of the drive surface of the valve 14 is slightly greater than the radius of the opening in the manifold 21 plus the offset of the center of the valve 14 from the center of the valve manifold 21. With this relationship the inside drive surface of the valve 14 will seal the opening throughout the operational valving orbit of the valve 14. This relationship is taught in the preferred embodiment of U.S. Pat. No. 4,877,383. Any fluid that does leak through the seal into the central wobblestick cavity is easily drained off: The fluid would be of very low volume and would be unpressurized. An internal drain connection is provided for this fluid.

The present invention provides a seal for the valve with a biasing piston, thus also isolating the high pressure to near the valve in a manner to prevent most leakage within the device.

Due to the confinement of the high pressure to the area near the valve 14, the invention of this application allows one to treat the gerotor structure 13 as a self-contained unit. The associated mechanical structure (like housing 11) need not have high pressure seals or other fluid containment means. The gerotor structure unit can be bolted onto a housing 11 or otherwise integrated into mechanical structures with little regard for the existence of the high pressure fluid within the gerotor structure 13. This fluid isolation allows the functions of the drive shaft 12 and housing 11 to be incorporated into the mechanical structures without the need for incorporating high pressure seals in such mechanical structures, significantly shortening the effective longitudinal length of the device. The fluid isolation also allows one to remove the gerotor structure 13 from its associated mechanical structure without regard for the fluid in the gerotor structure. Both the gerotor and mechanical structure can thus be easily interconnected, separated and repaired without regard for the other. Other advantages also flow from the isolation of fluid within the gerotor structure 13.

Due to the use of the biasing piston on the side of the valve 14, the mechanical sealing on the other side of the valve 14 is improved. In the preferred embodiment disclosed this includes the sealing over the bi-directional valving openings in the manifold 21. This improves the efficiency of the device.

The plate 23 is a thin plate trapped between the housing 11 and gerotor 22. The plate 23 generally seals the gerotor structure 13 against fluid leakage. If desired a small pocket can be incorporated behind it in the housing 11 which pocket is connected to a high pressure feed. This could be accomplished for example by including holes running axially through the rotor terminating at each face of the rotor. Other holes in the manifold plate 21 and plate 23 would be located within the confines of the area continually swept by the holes in the rotor. The holes in the rotor would sweep the holes in the manifold plate that are pressurized by high pressure, with the hole in the rotor in turn sweeping the holes in the plate 23 to pressurize the pocket in the housing 11. The pressure of fluid in the pocket in the housing would in turn force the plate 23 back towards the rotor pressure balancing same. If the device is designed for bi-directional rotation, small check valves could be utilized to insure the appropriate high pressure only connection. The size of the pocket in the housing 11 would be designed to match the rotor's axial imbalance for the incoming high pressure. The balancing plate is described in detail in the U.S. patent application Ser. No. 798,301 filed Nov. 15, 1985 by Mr. White issued as U.S. Pat. No. 4,717,320 on Jan. 5, 1988.

Figure 2:
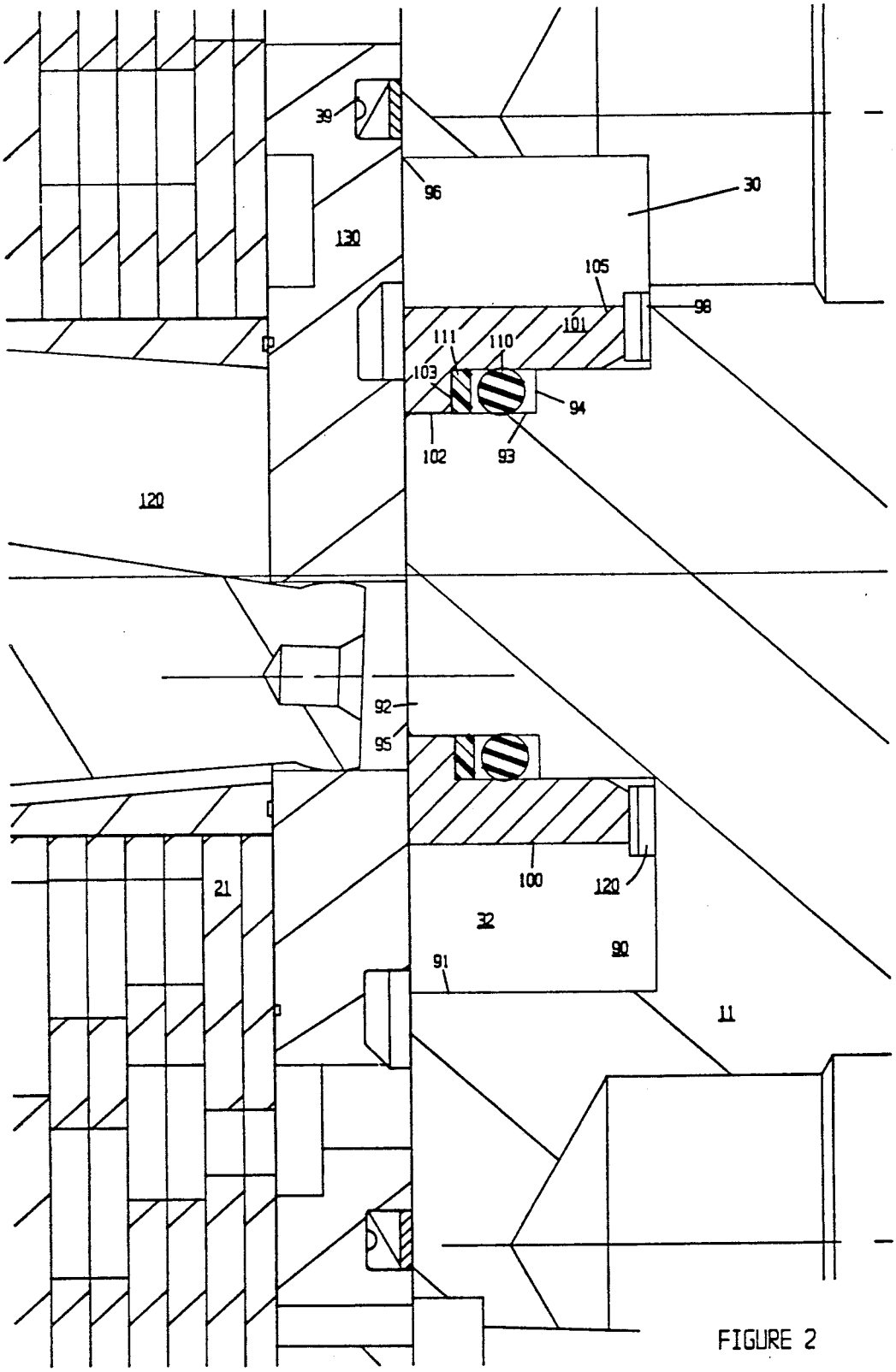
FIG. 2 is an enlarged view of the sealing area for the gerotor device shown in FIG. 1.
Figure 3:
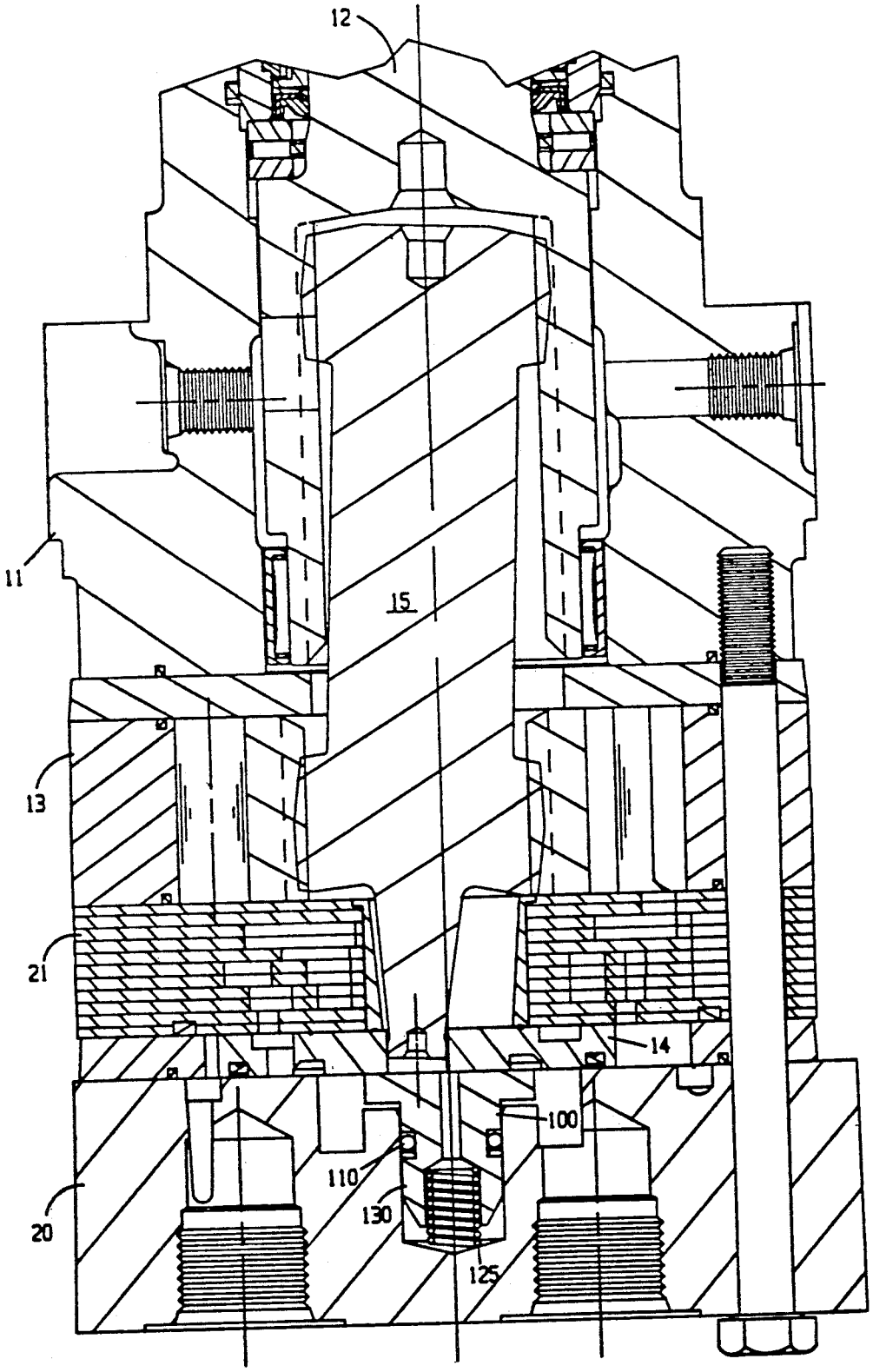
FIG. 3 is a view like FIG. 2 of a modified sealing structure.
Figure 4:
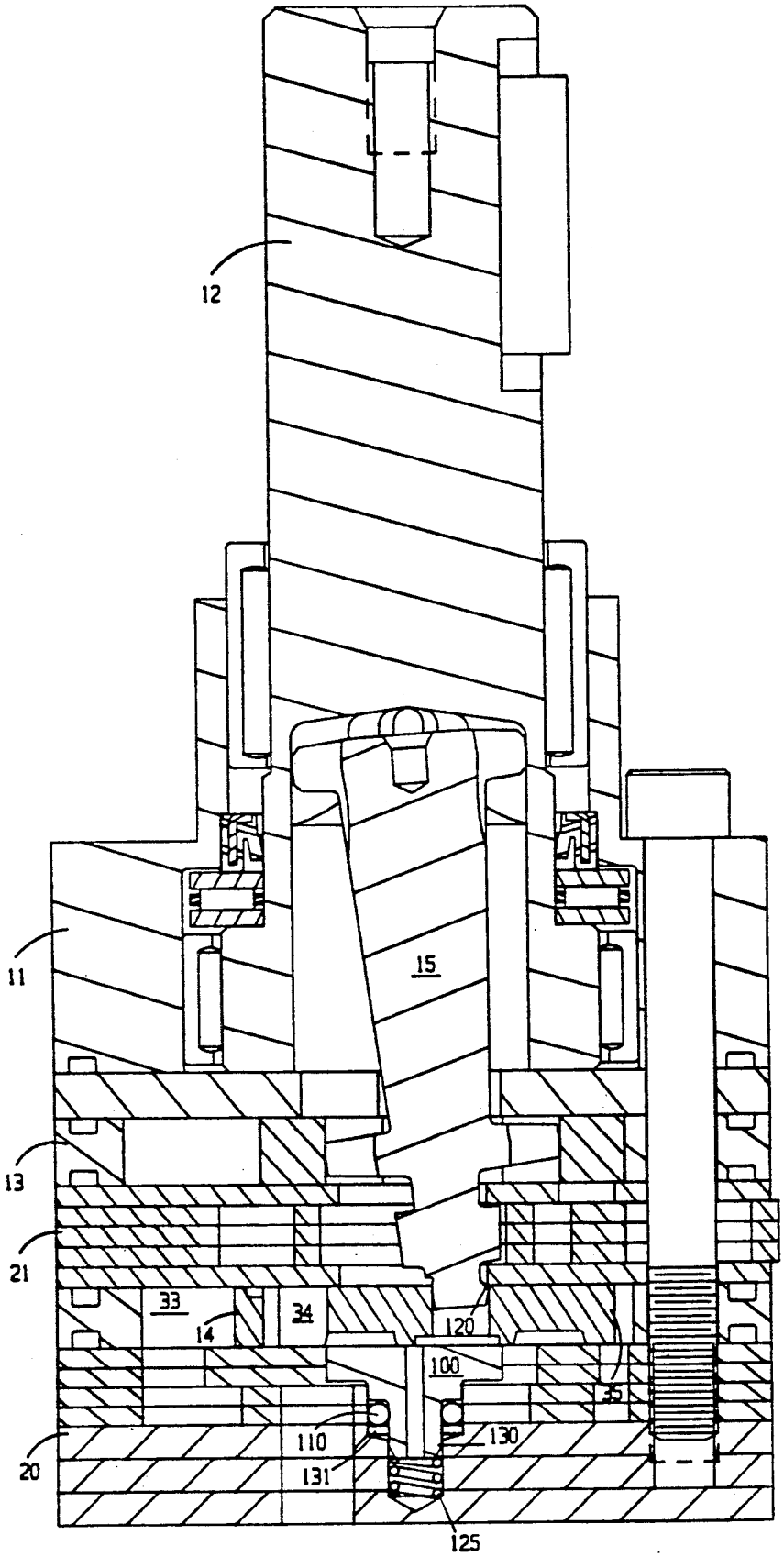
FIG. 4 is a variation of the modified sealing structure.

The wobblestick 15 connects the drive shaft 12 to both the rotor 16 and valve 14. In the preferred embodiment disclosed an integral extension or toe 40 extends off of the end of the wobblestick 15 to interconnect with the orbiting valve 14. In the embodiments of FIGS. 1-3, a semi-circular cross section tip 41 of such toe 40 extends into a circular opening 42 in the valve 14 with substantially no radial clearance therebetween. This provides for accurate valve timing. The interconnection of the wobblestick 15 to the orbiting valve 14 in the embodiment of FIG. 4 is similar with the addition of an indexing means (splines 120 shown) so as to connect the valve 14 to the wobblestick 15 for rotation therewith. The sides 42 of the toe 40 are designed to provide for the maximum cross sectional area along the full length of the toe 40. This strengthens the toe 40. It is preferred that the toe 40 have a slight taper or clearance along its length so as to allow for more than a token overlap between the face of the valve 14 inside of the central opening 34 and the inside surface of the manifold 21. This in combination with the longitudinally extending cap 44 on the inside surface of the manifold 21 provides for a good mechanical seal at this critical juncture. The cap 44 and valve 14 are preferably both of substantially equal hardness, in the embodiment shown-RC-60 steel.

In its orbiting motion the valve 14 connects the port 31 through the central opening 34 to some gerotor cells of the gerotor device 22 while connecting the port 30 through the surrounding edge 35 to others of gerotor cells of the gerotor device 22 through the manifold plate 21 as is customary for separate orbiting valve devices. In a major point of departure, however, fluid is generally isolated totally within the gerotor structure 13; neither the central opening of the rotor 16 nor the central opening 56 of the housing 11 are connected to any source of fluid. Any residue fluid that does manage to get into the openings or otherwise into this section of the device is easily drained off via a small passage 60 leading off of the openings to an external sump (as 86).

Due to the fluid isolation, the gerotor structure 13 forms a separate, totally integral device. This device can be attached and separated at any time without any concern for the condition of the fluid pressure fed to the ports 30, 31. The device can also be utilized with housings 11 not designed or otherwise supplied with high pressure seals. This isolation allows one to utilize gerotor structures in a greater variety of devices.

In this present invention the seals that allow this isolation for the valve 14 are provided by a spring biased piston 100 in a cavity 90 of the housing 11 (FIGS. 2, 3).

The piston 100 is utilized to bias or force a mechanical flat seal between the housing 11 (specifically the end plate 20 and manifold 21), and the valve 14 so as to seal the wobblestick toe drive area from fluid. In the preferred embodiment the piston 100 is a generally cylindrical shaped member 101. It is preferred that the piston 100 be manufactured of machinable steel having a hardness lower than that of the valve 14. This concentrates wear on the replaceable piston 100. Note that it is also preferred that the hardness of the piston 100 be such as to allow one to turn the cylindrical form of the piston 100 without the necessity for later heat treatment. In the embodiment disclosed the hardness of the piston 100 is approximately RC-37.

The piston 100 cooperates with the cavity 90 to create the bias or force for the mechanical flat seal. The cavity 90 is formed in the housing 11 of the gerotor motor 10, preferably in the end plate 20 on the opposite side of the valve 14 from the manifold 21. This allows a single piston to create seals on two surfaces of the valve 14. The cavity 90 itself a cylindrical opening 91 generally matching the shape of the piston 100.

It is preferred that the outer diameter of the cavity 90 near to the valve 14 is sufficiently greater than the outer diameter of the cylinder 100 so as to form a fluid ring or passage 32 therebetween. This creates this fluid passage 32 without the need for a separate manufacturing operation on the end plate 20. It also locates such passage as inwardly as possible. The passage 32 in turn is connected to one 31 of the two fluid ports for commutation as previously described.

The piston 100 of the preferred embodiment of FIGS. 1 and 2 has a two diameter hole 102 extending axially through the piston 100 for use with a central locating section 92 (later described) extending off of the end plate 20. A small step 103 is located between the two diameters of the hole 102. This small step 103 reduces the effective diameter of the piston 100 that is subjected to pressure (as later described). This reduction lowers the operational forces between the piston 100, valve 14 and manifold 21 to preferable sealing levels (i.e., levels to provide the mechanical seals without causing undue wear).

The cavity 90 that is utilized with this preferred embodiment includes a central locating section 92 (contrast FIG. 2 with FIGS. 3 or 4). The locating section 92 has two diameters 93 separated again by a small step 94. The diameters of the locating section 92 are generally selected to match the diameters of the hole 102 of the piston 100 radially support such piston 100 while also allowing the piston 100 to slide axially on the locating section 92. It is preferred that the end 95 of the locating section 92 be slightly recessed in respect to the plane of the valve 14 so as to avoid any interference with the valve 14 (as later described). In this respect note that the piston 100 could extend over the end of the locating section 92 if desired so as to present a uniform surface to the valve 14. This would spread out the load over a greater surface area, albeit at a cost of increased friction.

The gap between the piston 100 and cavity 90 is sealed so as to create the operative forces for the piston 100. In the embodiments shown in FIGS. 1 and 2, an "O" ring seal 110 is included between the step 94 of the locating section 92 and the step 103 of the piston 100. It is preferred that this seal 110 include a teflon backup 111 on the side opposite to the "O" ring from any high pressure interconnection (in this case the fluid passage 32 alone). This "O" ring seal 110 prevents any fluid from the passage 32 leaking between the locating section 92 and the piston 100 so as to interconnect through the end 41 of the locating section 92 to the center of the housing 11. This "O" ring seal 110 therefore accomplishes the purpose similar to that of the seal 38B in U.S. Pat. No. 4,877,383 as above described.

If no locating section 92 is included in the cavity 90, another guidance means should be provided for the piston 100. One guidance means is to have the outer diameter of the piston 100 contact the cavity 90 for at least part of its length (FIGS. 3 and 4). By reducing this section 130 of contact, again the biasing forces can be retained at preferable sealing levels. This reduced section 130 has substantially the same diameter as a part of the piston 100. The reduced section 130 can thus provide the same physical localization and guidance for the piston 100 as the locating section 92, albeit externally instead of internally. Again a step 131 is preferably included so as to reduce the area available for the cylinder effect. In the embodiments of FIGS. 3 and 4, a seal 110 is provided on the outer surface of the piston 100 to create the operative forces (again with teflon backup 111 if appropriate).

Note that in all embodiments, it is preferred that the piston 100 have a sufficient overlap with a flat surface of the valve 14 so as to provide for a mechanical flat seal without undue wear (caused primarily by a concentration of forces on too small an area). In general the lower the sealing force of the piston, the greater this area of contact must be. Preferably the force over the seal is approximately 100 PSI.

A spring is preferably included in the device so as to provide an initial bias for the piston. A wave spring 120 is included between the end 105 of the piston 100 and the back wall 98 of the cavity 90 in FIGS. 1 and 2. This wave spring 120 provides a bias for the piston 100 against the valve 14. This is useful on start up and shut down. A coil spring 125 is provided in FIGS. 3 and 4 for a similar purpose. In the preferred embodiment disclosed, this initial loading of the spring is substantially ten pounds. Upon pressurization of the device, the piston 100 will be forced outwards of the cavity 90 due to the pressure loading of the piston 100. In this pressure loading the surface area of the step 103 or 131 would be multiplied by the pressure of the fluid in the passage 32 so as to provide the operative sealing force for the piston 100 away from the back wall 98 of the cavity 90. Again it is preferred that this force be about 100 PSI.

The pressure of the piston 100 forces the piston 100 against one side of the valve 14. This seals the surface of contact between the piston 100 and the valve 14. Located on the other side of the valve 14 is a cap 44 on the inside of the multiplate manifold 21. This cap 44 extends about the circumference of the inner diameter of the manifold 21 and is brazed integrally thereto flush therewith. The outer diameter of this cap 44 is equivalent to the inner diameter of the manifold 21. The inner diameter of the cap 44 is of a shape and diameter sufficient to allow clearance for the movement of the wobblestick 15 during the operation of the device while also providing for an overlap of the surface of the valve 14 on the inside of the opening 34. Due to the force of the piston 100 on the other side of the valve 14, this overlap between the cap 44 and valve 14 is again a pressure loaded flat mechanical sealing contact. The piston 100 thus isolates the fluid in the valve 14 from the area within the cap 44 (and the center of the housing 11). Due to the location of the bi-directional valving holes on the surface of the same manifold 21 (surrounding the cap 44), this pressure loading also improves seals between adjoining valving openings against leakage at this critical area. This improves the fluidic efficiency of the device. Note that a separate seal 39 is preferably included for the area not pressure loaded by the piston 100. This seal 39 slightly increases the efficiency of the device by sealing between the two valving openings 33, 34 of the valve 14. This seal 39 does not pass over any openings. A separate seal 39 can therefore be utilized. As the outer edge of the valve 14 is not subject to the same dimensional, wear or other restrictions as the center of the valve, this use is acceptable.

By utilizing the cylinder or piston 100 to bias the valve 14 into a solid sealing contact with the cap 44 of the manifold 21, the seal for the center of the housing 11 can be provided in a smaller area than before. With a piston 100 providing the sealing, it is possible for the circular opening 42 and valving opening 34 of the valve 14 to sweep the same area without compromising the sealing. This allows optimization of the device sizing. The piston 100 also allows one to increase the size of the drive (the toe 40) that interconnects the wobblestick 15 and valve 14, strengthening this critical interconnection. The piston 100, by allowing one to eliminate the "O" ring or other separate seals for the center of the housing 11, simplifies the manufacture, repair and operation of the device. The use of a piston 100 also allows one to improve the sealing of an area that sweeps over holes or protuberances without concern for the longevity of the seal. This, for example, allows one to improve the sealing of the device at the bi-directional valving holes swept by the valve 14. This improves the overall efficiency of the device without longevity compromises. Therefor although the invention has been described in its preferred form with a certain degree of detail, it is to be understood that numerous changes could be made without departing from the invention as hereinafter claimed.

What is claimed:

1. An improvement for a device having a housing with a stationary body and an orbiting valve selectively interconnecting fluid of two ports to expanding and contracting motor cells through bi-directional fluid passages through the stationary body of the housing of the device, the orbiting valve directly rotated by an orbiting drive shaft extending through a central opening of the device to connect to the valve with the diameter of the central opening being larger than the diameter of the drive shaft extending therethrough, and a means to seal the central opening from the fluid in the orbiting valve, the improvement comprising the means to seal the central opening from fluid in the orbiting valve including a piston, a cavity, said cavity being in the stationary body next to the orbiting valve, said piston being in said cavity in the stationary body next to the orbiting valve, and bias means to bias said piston against the orbiting valve.

2. The improvement of claim 1 characterized in that said bias means includes a spring.

3. The improvement of claim 1 characterized by the addition of a locating section, said locating section extending off of the stationary body into said cavity, said piston having a hole and said locating section being in said hole in said piston.

4. The improvement of claim 3 wherein there is a gap between said piston and said locating section and characterized by the addition of a seal and said seal sealing the gap between said piston and said locating section.

5. The improvement of claim 4 characterized in that said piston has a step, said locating section has a step, and said seal being located between said step of said piston and said step of said locating section.

6. The improvement of claim 1 wherein there is a gap between said piston and said cavity and characterized by the addition of a seal and said seal sealing the gap between said piston and said cavity.

7. The improvement of claim 7 characterized in that said piston has a step, said cavity has a step, and said seal being located between said step of said piston and said step of said locating section.

8. An improvement for a device having a stationary body and an orbiting valve selectively interconnecting fluid of two ports to manifold openings at a surface, and the orbiting valve having an inner opening of a certain radius about an inside drive surface and a certain orbit offset, the orbiting valve directly rotated by an orbiting drive shaft extending through a central opening in the surface of the manifold, and the central opening having a certain radius with the diameter of the central opening being larger than the diameter of the drive shaft extending therethrough, the minimum radius of the inner opening of the orbiting valve being greater than the sum of the radius of the central opening plus the orbit offset for the device with the inside drive surface of the orbiting valve sealing the central opening in the surface of the manifold such that the inner opening of the orbiting valve never communicates with the central opening of the manifold, the improvement comprising the addition of a piston, a cavity, said cavity being in the stationary body of the device next to the orbiting valve, said piston being in said cavity in the stationary body in contact with the orbiting valve and means to bias said piston against the orbiting valve.

9. The improvement of claim 8 characterized in that said bias means includes a spring.

10. The improvement of claim 8 characterized by the addition of a locating section, said locating section extending off of the stationary body in said cavity, said piston having a hole and said locating section being in said hole in said piston.

11. The improvement of claim 8 wherein the device has a manifold with openings and the orbiting valve has an outer circumferential surface against the device on the opposite side of the orbiting valve from the manifold openings and characterized by the addition of a seal, said seal extending between the outer circumferential surface of the orbiting valve and the device.

12. An improvement for a device having a stationary body an an orbiting valve selectively interconnecting fluid of two ports to manifold openings at a surface, the orbiting valve having an inner valving opening of a certain radius about an inside drive surface and a certain orbit offset, the orbiting valve rotated by an orbiting drive shaft extending through a central opening in the surface of the manifold to a drive opening in the inside drive surface of the valve, the central opening of the manifold having a certain radius, the diameter of the central opening being larger than the diameter of the drive shaft extending therethrough, the radius of the inner valving opening of the orbiting valve being greater than the sum of the radius of the central opening plus the orbit offset for the device with the inside drive surface of the orbiting valve sealing the central opening in the surface of the manifold such that the inner valving opening of the orbiting valve never communicates with the central opening of the manifold, and a means to seal the drive opening in the valve from fluid, the improvement of the means to seal the drive opening in the valve from fluid comprising a cavity, said cavity being in the stationary body next to the orbiting valve, a locating section, said locating section being in said cavity, said locating station being fixedly connected to the stationary body, a piston, said piston having a hole, said piston being in said cavity next to the orbiting valve with said locating section being in said hole, a fluid passage, said fluid passage being located between said piston and the stationary body surrounding said cavity, said fluid passage being part of the interconnection between a port and the orbiting valve, and a means to bias said piston against the orbiting valve.

13. The improvement of claim 12 characterized in that said bias means includes a spring.

14. An improvement for a device having a stationary body an an orbiting valve selectively interconnecting fluid of two ports to manifold openings at a surface, the orbiting valve having an inner valving opening of a certain radius about an inside drive surface and a certain orbit offset, the orbiting valve rotated by an orbiting drive shaft extending through a central opening in the surface of the manifold to a drive opening in the inside drive surface of the valve, the central opening of the manifold having a certain radius, and with the diameter of the central opening being larger than the diameter of the drive shaft extending therethrough, the radius of the inner valving opening of the orbiting valve being greater than the sum of the radius of the central opening plus the orbit offset for the device with the inside drive surface of the orbiting valve sealing the central opening in the surface of the manifold such that the inner valving opening of the orbiting valve never communicates with the central opening of the manifold, and a means to seal the drive opening in the valve from fluid, the improvement of the means to seal the drive opening in the valve from fluid comprising a cavity, said cavity being in the stationary body next to the orbiting valve, a piston, said piston being in said cavity next to the orbiting valve, said piston being in contact with said orbiting valve, a fluid passage, said fluid passage being located between said piston and the stationary body surrounding said cavity, said fluid passage being part of the interconnection between a port and the orbiting valve, a spring, said spring being located between said piston and the stationary body of the device, said spring biasing said piston against the orbiting valve, a step, said step being in said piston, a second step, said second step being located in the stationary body neighboring said step in said piston, a seal, and said seal being located between said step and said second step.

15. The improvement of claim 14 characterized in that said seal is located between said fluid passage and said spring.

16. The improvement of claim 14 characterized in that said spring is located in said fluid passage.

17. The improvement of claim 14 characterized by the addition of a locating section, said locating section extending off of the stationary body into said cavity, a hole, said hole being in said piston, and said locating section extending into said hole in said piston.

18. An improvement for a device having a housing with a stationary body and an orbiting valve selectively interconnecting fluid of two ports to expanding and contracting gerotor cells through bidirectional fluid passages in the stationary body of the housing of the device, the orbiting valve directly rotated by an orbiting drive shaft extending through a central opening in the body of the device to connect to the valve, the diameter of the central opening being larger than the diameter of the drive shaft extending therethrough, with the orbiting valve facing a surface of the housing, the improvement of a cavity, said cavity being the surface of the housing facing the orbiting valve, a piston, said piston being in said cavity, and means to bias said piston towards said orbiting valve so as to bias said orbiting valve towards the body of the device surrounding the central opening.

19. An improvement for a device having a housing with a stationary body and an orbiting valve selectively interconnecting fluid of two ports to expanding and contracting gerotor cells through bidirectional passages in the stationary body of the housing of the device, the orbiting valve directly rotated by an orbiting drive shaft extending through a central opening in the body of the device to connect to the valve with a diameter of the central opening being larger than the diameter of the drive shaft extending therethrough, the orbiting valve having a central valving opening with a minimum extension to the longitudinal axis of such orbiting valve, the improvement of the diameter of the central opening of the device being less than the minimum radius of the central valving opening minus the offset of the valve such that the central valving opening does not interconnect with the central opening of the device throughout the operation of the orbiting valve, a piston, a cavity in the stationary body of the device on the opposite side of the orbiting valve from said central opening, said piston being in said cavity and bias means to bias said piston towards said orbiting valve and said orbiting valve into physical contact with the area surrounding the central opening in the body of the device so as to seal said central opening in the body of the device.

* * * * *